US011532890B2

(12) United States Patent
Lu et al.

(10) Patent No.: US 11,532,890 B2
(45) Date of Patent: Dec. 20, 2022

(54) FREQUENCY SELECTIVE SURFACE ZONING TECHNIQUE TO REDUCE THE COMPLICATION IN DESIGN FROM LARGE RANGE OF ILLUMINATION INCIDENT ANGLES

(71) Applicant: HUGHES NETWORK SYSTEMS, LLC, Germantown, VA (US)

(72) Inventors: Bingqian Lu, Olney, MD (US); Peter Hou, Gaithersburg, MD (US); Kunj Desai, Germantown, MD (US); Taiwei Yue, Germantown, MD (US); Anthony Fanelli, Falls Church, VA (US)

(73) Assignee: Hughes Network Systems, LLC, Germantown, MD (US)

( * ) Notice: Subject to any disclaimer, the term of this patent is extended or adjusted under 35 U.S.C. 154(b) by 615 days.

(21) Appl. No.: 16/237,656

(22) Filed: Dec. 31, 2018

(65) Prior Publication Data

US 2020/0212586 A1 Jul. 2, 2020

(51) Int. Cl.

| | |
|---|---|
| ***H01Q 15/00*** | (2006.01) |
| ***H01Q 19/10*** | (2006.01) |
| ***H01Q 13/02*** | (2006.01) |
| ***H01Q 19/13*** | (2006.01) |
| ***H01Q 19/19*** | (2006.01) |

(52) U.S. Cl.

CPC ..... *H01Q 15/0026* (2013.01); *H01Q 13/02* (2013.01); *H01Q 15/0013* (2013.01); *H01Q 19/10* (2013.01); *H01Q 19/132* (2013.01); *H01Q 19/192* (2013.01)

(58) Field of Classification Search

CPC .... H01Q 13/02; H01Q 15/0026; H01Q 19/10; H01Q 19/132; H01Q 19/192

See application file for complete search history.

(56) References Cited

U.S. PATENT DOCUMENTS 5,373,302 A * 12/1994 Wu ..... H01Q 15/0033 343/781 CA
5,471,224 A * 11/1995 Barkeshli ..... H01Q 19/195 343/909
6,512,485 B2 1/2003 Luly et al.
2017/0264020 A1* 9/2017 Jackson ..... H01Q 19/191

FOREIGN PATENT DOCUMENTS

KR 20130008817 A 1/2013

OTHER PUBLICATIONS

Antenna Theory: A Review, Balanis, Proc. IEEE vol. 80 No. 1 Jan. 1992 (Year: 1992).*

International Search Report and Written Opinion issued in Application No. PCT/US19/68222, dated Apr. 27, 2020.

* cited by examiner

*Primary Examiner* — Andrea Lindgren Baltzell
*Assistant Examiner* — Amal Patel
(74) *Attorney, Agent, or Firm* — Potomac Technology Law, LLC

(57) ABSTRACT

A method for providing frequency selective surface zoning includes selecting a location for positioning a frequency selective surface (FSS) panel along a support arm of a reflector antenna system, and positioning a second feed horn on the support arm on an opposite side of the FSS panel. A number of unit cells are used to populate the FSS panel, and metallic patterns are formed on each unit cell. Multiple zones are subsequently defined on the surface of the FSS panel. Each zone is optimized for a predetermined range of incident angles.

17 Claims, 13 Drawing Sheets

FREQUENCY SELECTIVE SURFACE ZONING TECHNIQUE TO REDUCE THE COMPLICATION IN DESIGN FROM LARGE RANGE OF ILLUMINATION INCIDENT ANGLES

BACKGROUND INFORMATION

Frequency Selective Surfaces (FSS) are periodic structures composed of metal patches or patterns that transmit or/and reflect electromagnetic (EM) waves in certain frequency ranges. There are four types of frequency responses that can typically be obtained from FSS: low-pass, high-pass, band-stop, and band-pass. Band-stop and band-pass frequency responses are most frequently used to achieve precise and elaborate performance. The use of FSS has recently increased due to their use in a wide variety of applications from microwave systems and antennas to radar and satellite communication.

There are several challenges associates with the use of FSS elements. For example, it can be difficult to achieve a wide bandwidth, a wide range of incident angle stability, and polarization stability. FSS elements that are predesigned as a frequency will transmit certain frequency bands and reflect others when spatially illuminated by a feed antenna. Various challenges can occur, however, when the two frequencies are far apart, such as the case of Ku and Q bands (10 GHz and 40 GHz). Additional challenges can present themselves when the incident angle or polarization changes, because the same FSS element will show different response. These challenges also deter the use of FSS elements in conformal radomes or other structures.

Based on the foregoing, there is a need for an approach for obtaining an FSS with stable polarization performance, wide bandwidth response and wide incident angle range response.

BRIEF SUMMARY

A system and method for providing frequency selective surface zoning, is described. According to an embodiment, the system includes a reflector antenna unit comprising: a reflector dish mounted on a base, a support arm extending from the base, a first feedhorn mounted at an end of the support arm and configured to operate in a first frequency range, a second feedhorn mounted on the support arm and configured to operate in a second frequency range; and an FSS panel disposed between the first feedhorn and the second feedhorn, the FSS panel comprising: a foam backing, a dielectric film disposed on the foam backing, a plurality of unit cells defined on the dielectric film, a plurality of metallic patterns formed on the dielectric film, and one or more zones defined on the surface of the FSS panel, wherein the FSS panel is equidistant from the first feed horn, and wherein the FSS panel transmits waves in the first frequency range and reflects waves in the second frequency range.

According to another embodiment, the method includes: selecting a location for positioning a frequency selective surface (FSS) panel along a support arm of a reflector antenna system; determining a first distance between the FSS panel and a first feedhorn operating on a first frequency range; positioning a second feed horn on the support arm at a second distance from the FSS panel, the second distance being equal to the first distance and in an opposite direction from the FSS panel; determining a number of unit cells required to form the FSS panel based, at least in part, on the selected location and the first distance; forming metallic patterns on each unit cell; and defining one or more zones on the surface of the FSS panel, each zone having unit cells with different metallic patterns, wherein the second feedhorn operates on a second frequency range, and wherein the FSS panel transmits waves in the first frequency range and reflects waves in the second frequency range.

The foregoing summary is only intended to provide a brief introduction to selected features that are described in greater detail below in the detailed description. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

A method and system for providing frequency selective surface zoning, is described. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement. In other instances, well-known structures and devices are shown in block diagram form in order to avoid unnecessarily obscuring the various embodiments.

Figure 1:
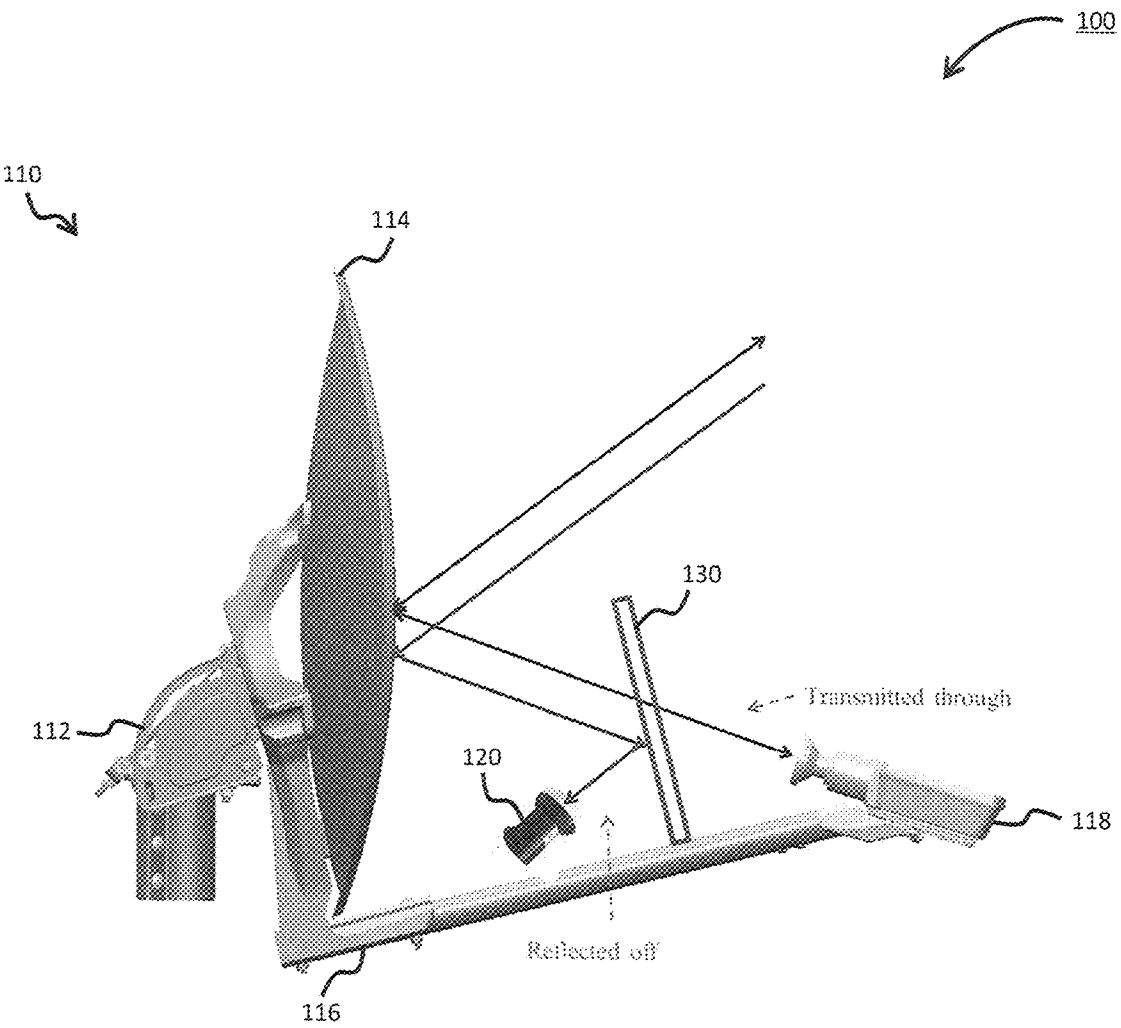
FIG. 1 is a diagram of a system capable of providing frequency selective surface zoning, according to one embodiment.

FIG. 1 is a diagram of a system capable of providing frequency selective surface zoning, according to one embodiment. The system 100 includes a reflector antenna unit 110 and a frequency selective surface (FSS) panel 130. The reflector antenna unit 110 includes a base 112 upon which a reflector dish 114 is mounted. The reflector antenna unit 110 also includes a support arm 116 which extends from the base 112. According to the illustrated embodiment, a first feedhorn 118 is mounted at a free end of the support arm 116. The first feedhorn 118 can be used, for example, to illuminate the surface of the reflector dish 114 with an electromagnetic wave. According to one or more embodiments, the first feedhorn 118 can be configured to operate at a first frequency range. The first feedhorn 118 can be configured, for example, to transmit and receive electromagnetic waves in the Ka frequency band. Depending on the specific implementation, the first feedhorn 118 can also be configured to receive electromagnetic signals reflected from the reflector dish 114.

Although not illustrated in FIG. 1, the first feedhorn 118 further include various components necessary to generate and transmit the electromagnetic waves to illuminate the surface of the reflector dish 114. For example, the first feedhorn 118 can be configured to incorporate a transmitter unit and a receiver unit. The receiver unit would be used to receive and amplify outroute signals received from a satellite, and down-convert the Ka-band frequency signals used by the satellite to L-band frequency signals. The transmitter unit would receive L-band signals from a terrestrial source up-convert them to Ka-band signals for transmission to the satellite 270. While the first feedhorn 118 is indicated as operating within the Ka-band, it should be noted that other frequency bands (e.g., Ku, C, L, Q, etc.) can also be used.

According to the illustrated embodiment, a frequency selective surface (FSS) panel 130 is mounted on the support arm 116 at a predetermined distance from the first feedhorn 118. The FSS panel 130 is selected such that it is capable of providing coverage over the entire surface area of the reflector dish 114 that is illuminated by the first feedhorn 118. More particularly, the reflector dish 114 can have different configurations (e.g., circular, parabolic, etc.) based on the particular application. The first feedhorn 118 must therefore be configured and oriented so as to illuminate the entire surface of the reflector dish 114. Accordingly, the FSS panel 130 is sized and positioned such that electromagnetic waves from the first feedhorn 118 are still capable of illuminating the entire surface of the reflector dish 114 after passing through the FSS panel 130.

According to one or more embodiments, the system 100 can be configured so as to support multiple feedhorns. As further illustrated in FIG. 1, for example, a second feedhorn 120 can also be mounted on the support arm 116 of the reflector antenna unit 110. The second feedhorn 120 is positioned such that the FSS panel 130 is equidistant from both the first feedhorn 118 and the second feedhorn 120. More particularly, once the size and location of the FSS panel 130 have been determined, the second feedhorn 120 is mounted on the support arm 116 at a distance that is equal to the distance between the first feedhorn 118 and the FSS panel 130. The second feedhorn 120 can be configured, for example, to operate within an entirely different frequency range (i.e., a second frequency range) from the frequency range being utilized by the first feedhorn 118. According to an embodiment, the second feedhorn 120 is configured to operate in the Q-band frequency range. As illustrated in FIG. 1, the second feedhorn 120 is oriented in the direction of the FSS panel 130 and toward the first feedhorn 118. The FSS panel 130 is configured to reflect electromagnetic waves in the second frequency range, while transmitting electromagnetic waves in the first frequency range.

As illustrated in FIG. 1, the second feedhorn 120 can be configured as a receiver which receives, for example, Q-band electromagnetic waves collected by the reflector dish 114. Such electromagnetic waves are reflected by the FSS panel 130 and received at the second feedhorn 120. According to various embodiments, however, the second feedhorn 120 can also be configured to transmit and receive electromagnetic waves in the second frequency range. According to such embodiments, electromagnetic waves transmitted by the second feedhorn 120 would be reflected by the FSS panel 130 in order to illuminate the surface of the reflector dish 114. In contrast, electromagnetic waves in the first frequency range that are transmitted by the first feedhorn 118 are transmitted through the FSS panel 130 in order to illuminate the surface of the reflector dish. Electromagnetic waves in the first frequency range are also collected by the reflector dish 114 and passed through the FSS panel 130 so that they are received at the first feedhorn 118.

Figure 2:
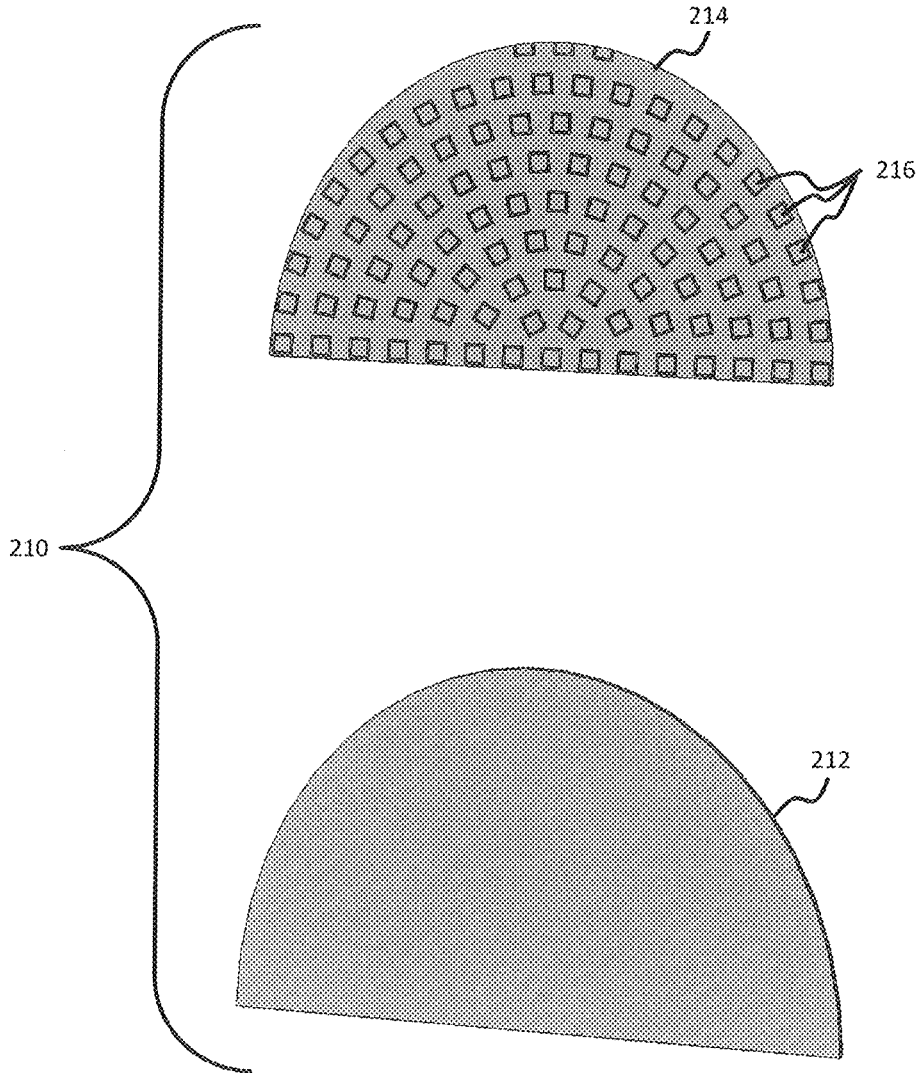
FIG. 2 is a diagram of a frequency selective surface panel useable in the system of FIG. 1, according to one embodiment.

FIG. 2 illustrates a configuration for an FSS panel 210 in accordance with at least one embodiment. The FSS panel 210 can incorporate, for example, multiple layers. Specifically, the FSS panel 210 can consist of a foam backing having the necessary dimensions to provide coverage of the entire surface area of the reflector dish. Depending on the specific system requirements, the thickness of the foam backing 212 can also vary. A dielectric layer such as polyester (PET) film 214 with corresponding dimensions to the foam backing 212 is disposed on a surface of the foam backing 212. According to various embodiments, other types of dielectric materials can be used in place of the PET film 214.

A plurality of unit cells 216 are subsequently defined on the surface of the PET film 214. The specific dimensions for the unit cells 216 can be selected based on the particular design application. Furthermore, the size of the unit cells 216 can be optimized depending on the desired system performance. For example, the FSS panel 210 can contain 100 unit cells 216 of a first size, or the FSS panel can contain 60 unit cells 216 having a second size that is larger than the first size. According to various embodiments, metallic patterns (see FIG. 3) can be formed on the PET film 214. Additionally, the metallic patterns are formed on the surface of the PET film 214 such that they are positioned at locations defined by the unit cells 216. As will be discussed in greater detail with respect to FIG. 4, the metallic patterns can have a variety of shapes and configurations. Various features of the metallic patterns can also be optimized in order to achieve desired results for a particular system.

Figure 3:
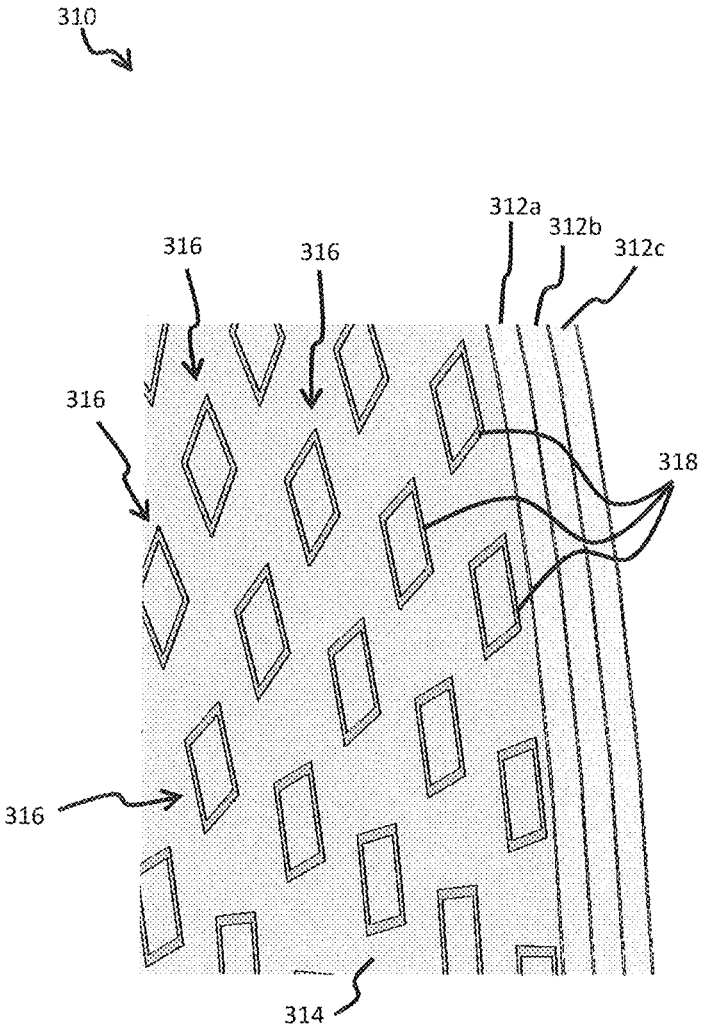
FIG. 3 is a diagram of a frequency selective surface panel, according to one or more embodiments.

FIG. 3 illustrates a configuration for an FSS panel of 310 in accordance with at least one embodiment. The FSS panel 310 differs from that illustrated in FIGS. 1 and 2 by having multiple layers stacked together. For example, the FSS panel 310 includes a first foam backing 312*a* having a PET film 314 (or other appropriate dielectric layer) disposed on its surface. Various unit cells 316 are further defined on the surface of the PET film 314. A plurality of metallic patterns 318 are also formed on the surface of the PET film 314. As illustrated in FIG. 3, the metallic patterns 318 are configured such that they are formed at the locations defined by the unit cells 316. The FSS panel 310 also includes a second foam backing 312*b* that also contains a PET film, a plurality of unit cells, and a plurality of metallic patterns (not shown) to form a second layer. Similarly, the FSS panel 310 includes a third foam backing 312*c* also having a PET film disposed on its surface, a plurality of unit cells, and a plurality of metallic patterns which define a third later.

While FIG. 3 illustrates the FSS panel 310 as having three layers, it should be noted that the number of layers utilized in the FSS panel 310 can vary depending on specific system requirements. Accordingly, the FSS panel 310 should not be construed as having only three layers. Rather any number of layers and configurations can be utilized in order to achieve a desired performance and/or characteristic. Furthermore, different dielectric layers (or films) can be disposed on the foam backing 312 in place of the PET film. Various embodiment can further utilize laminated dielectric materials having, for example, three metallic layers and two dielectric layers sandwiched therebetween. Various etching and deposition techniques could subsequently be used to form the desired metal patterns.

Figure 4:
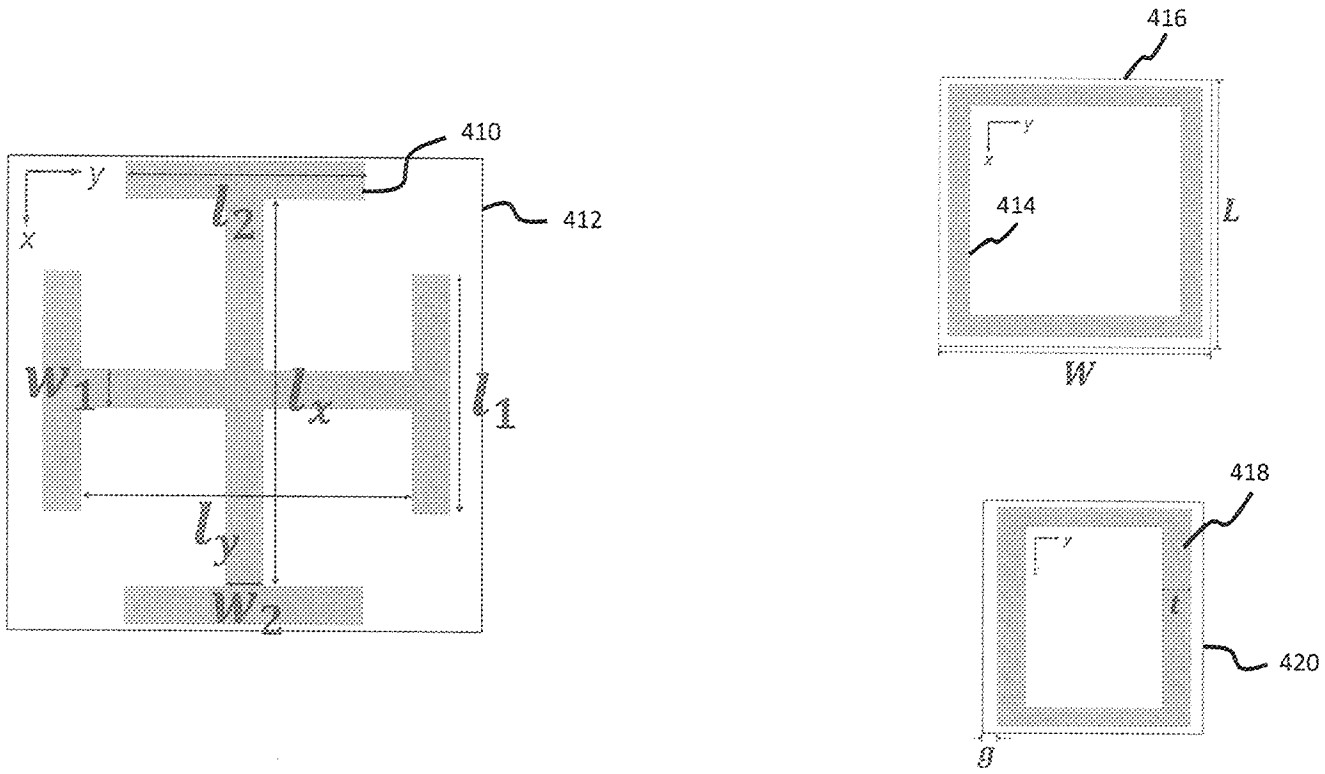
FIG. 4 is a diagram of various metallic pattern geometries that can be used with a frequency selective surface panel, in accordance with various embodiments.

FIG. 4 illustrates exemplary configurations for metallic patterns, in accordance with various embodiments. The first metallic pattern 410 is in a configuration of a Jerusalem cross. As further illustrated in FIG. 4, the metallic pattern 410 is formed in an area defined by a unit cell 412. The first metallic pattern 410 has various geometric features that can be adjusted in order to optimize or achieve a desired result. For example, the first metallic pattern contains various length and width components (i.e., $l_x$, $l_y$, $l_1$, $l_2$, $w_1$, $w_2$, $w_3$, $w_4$) whose values can be increased or decreased in order to achieve desired results. Thus, various optimization techniques can be applied in order to determine which dimensions should be increased or decreased. The optimization process can further include selection of the thickness of the foam backing, particularly when FSS panels having multiple layers are being utilized. Furthermore, the metallic patterns on different layers can have the same geometric configuration, but with different dimensions.

The second metallic pattern 414 has the geometric configuration of a square, and is formed within an area defined by a unit cell 416. FIG. 4 further illustrates a third metallic patter 418 having a rectangular configuration. The third metallic pattern 418 is also formed within an area defined by a unit cell 420. The second metallic pattern 414 and third metallic pattern 418 also contain various properties that can be increased or decreased in order to achieve desired results. While the second and third metallic patterns 414, 418 are indicated as being different, it should be noted that they represent the same geometric configuration (i.e., a square) with adjustments in different properties.

According to various embodiments, a plurality of zones can be defined on the surface of the FSS panel. The different zones can be used to achieve improved performance by optimizing geometries in each of the zones for a smaller set of required incident angles. Such features differ from conventional configurations which attempt to optimize a single FSS geometry for the entire range of incident angles. According to at least one embodiment, the zones can be defined based, at least in part, on the incident angle of electromagnetic waves emitted from the first feedhorn. The incident angle can include, for example, a Φ component and a θ component. The Φ and θ components are utilized in order to generate a mapping on the surface of the FSS panel which defines the different zones.

Figure 5:
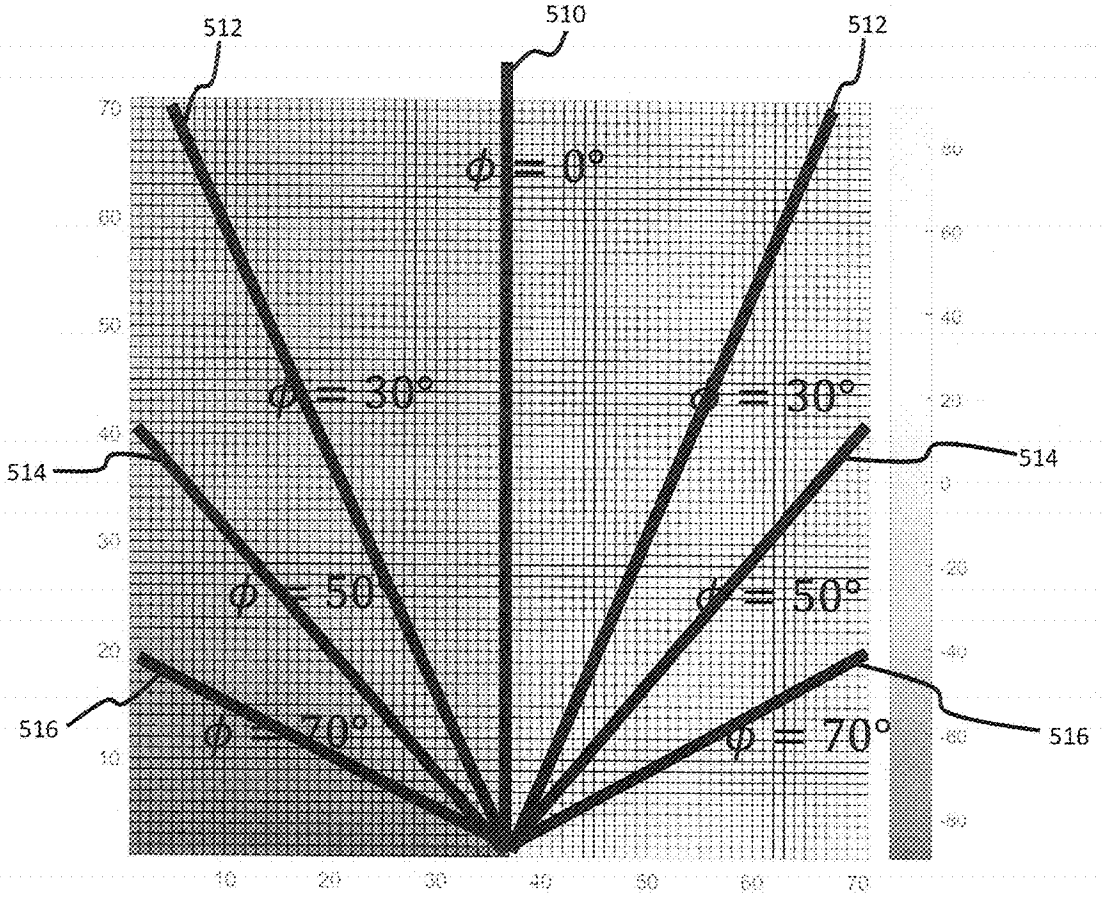
FIG. 5 is a diagram illustrating mapping of a frequency selective surface panel based on a first criteria, in accordance with various embodiments.

FIG. 5 illustrates a mapping of selected Φ component values on the surface of the FSS panel. According to an embodiment, the FSS panel surface is radially divided using a plurality of radial lines. Each of the radial lines corresponds to a predetermined value for the Φ component of incident angles from waves emitted by the first feedhorn. For example, radial line 510 corresponds to a value of 0° for the Φ component of incident angles from the first feedhorn which contact the FSS panel. Radial line 512 corresponds to a value of 30° for the Φ component of the incident angle of waves from the first feedhorn and the second feedhorn. Similarly, radial line 514 corresponds to a value of 50°, while radial line 516 corresponds to a value of 70° for the Φ component. As illustrated in FIG. 5, the radial lines corresponding to values of the Φ component are symmetrically aligned with each other relative to the radial line corresponding to a value of 0°.

Figure 6:
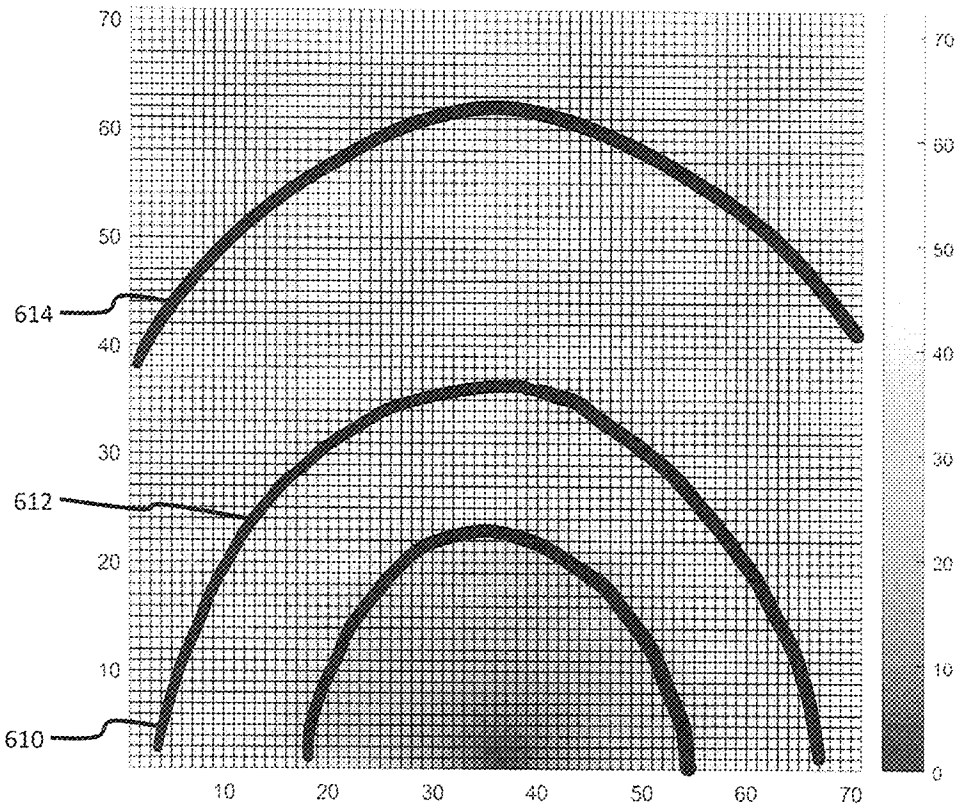
FIG. 6 is a diagram illustrating mapping of a frequency selective surface panel based on a second criteria, in accordance with various embodiments.

FIG. 6 illustrates a mapping of selected θ component values on the FSS panel surface. Mapping of the θ component values causes the FSS panel surface to be rotationally divided using a plurality of arcs. Each arc can correspond, for example, to a predetermined value for the θ component of incident angles of waves from the first feedhorn. For example, arc 610 corresponds to a first value of the θ component for incident angles of waves from the first feedhorn. Similarly, arcs 612 and 614 corresponds to second and third values for the θ component of incident angles of waves from the first feedhorn.

Figure 7:
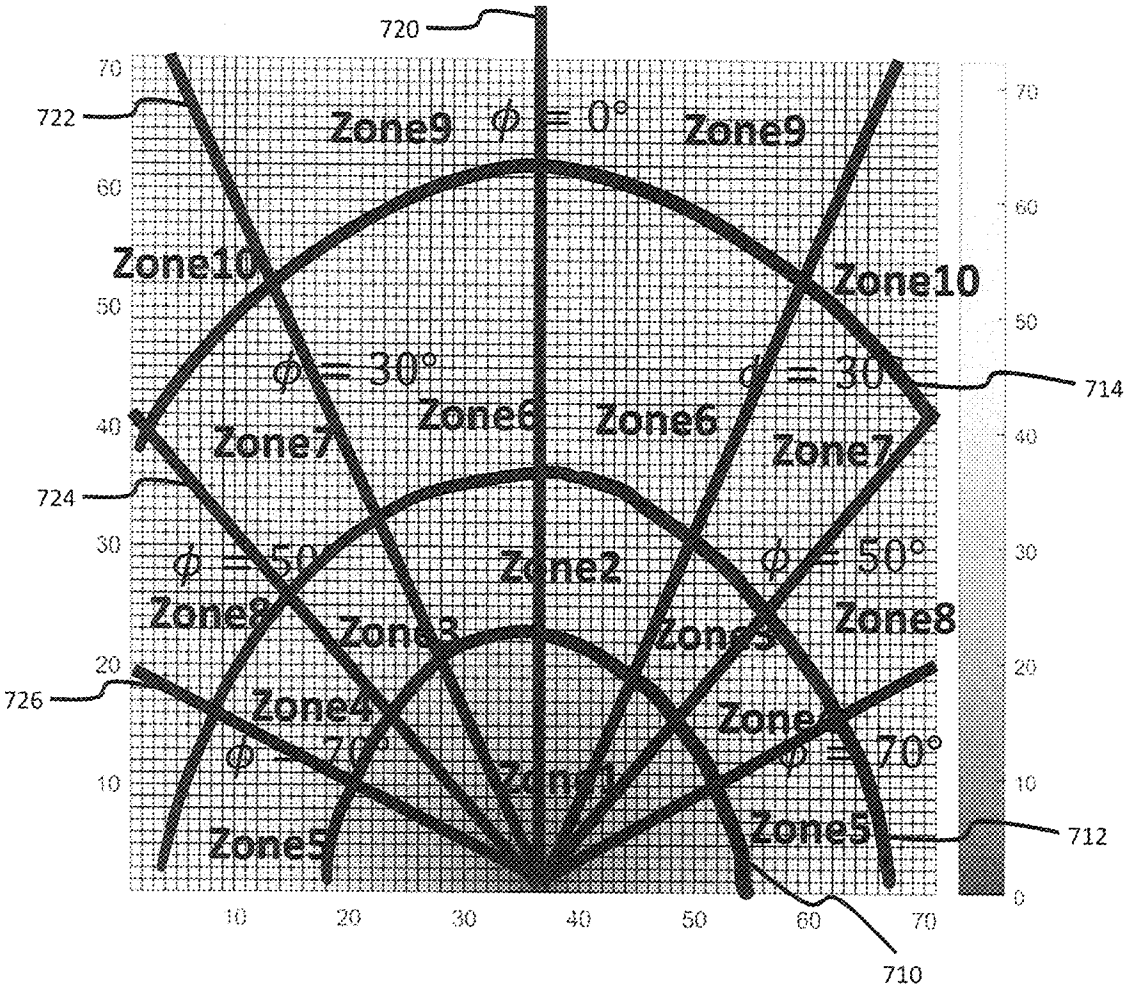
FIG. 7 is a diagram illustrating zones that can be defined based on the different mappings, in accordance with an embodiment.

Referring to FIG. 7, the radial mapping of the Φ component and the rotational mapping of the θ component are combined by superimposing them onto the surface of the FSS panel. This results in the creation of multiple zones. As illustrated in FIG. 7, zone 1 is defined by arc 710 without accounting for the radial lines of the Φ component. Zones 2-4, 6, and 7 are defined by segments of the radial lines and segments of the arcs. For example, zone 2 is defined by a segment of radial line 720 corresponding to a value of 0° for the Φ component, a segment of radial line 722, a segment of arc 710, and a segment of arc 712. Similarly, zone 3 is defined by a segment of radial line 722, a segment of radial line 724, a segment of arc 710, and a segment of arc 712. Zones 8 to 10, however, are additionally defined by outer edges of the FSS panel. More particularly, zone 8 is defined by a segment of radial line 724, a segment of radial line 726, and a segment of arc 712. The open portion would be constrained by the edge of the FSS panel rather than arc 714.

As further illustrated in FIG. 7, zones 2 to 10 are symmetrically disposed on either side of radial line 720. Once the zones have been defined on the surface of the FSS panel, different types of unit cells configurations can be used to populate the different zones. For example, a first unit cell configuration can be used to populate the area defined by zone 2, while a second (i.e., different) unit cell configuration can be used to populate the area defined by zone 7. Accordingly, each particular zone can contain unit cells specifically configured and/or optimized for a smaller range of incident angles in order to provide a desired result or satisfy particular design criteria.

Figure 8:
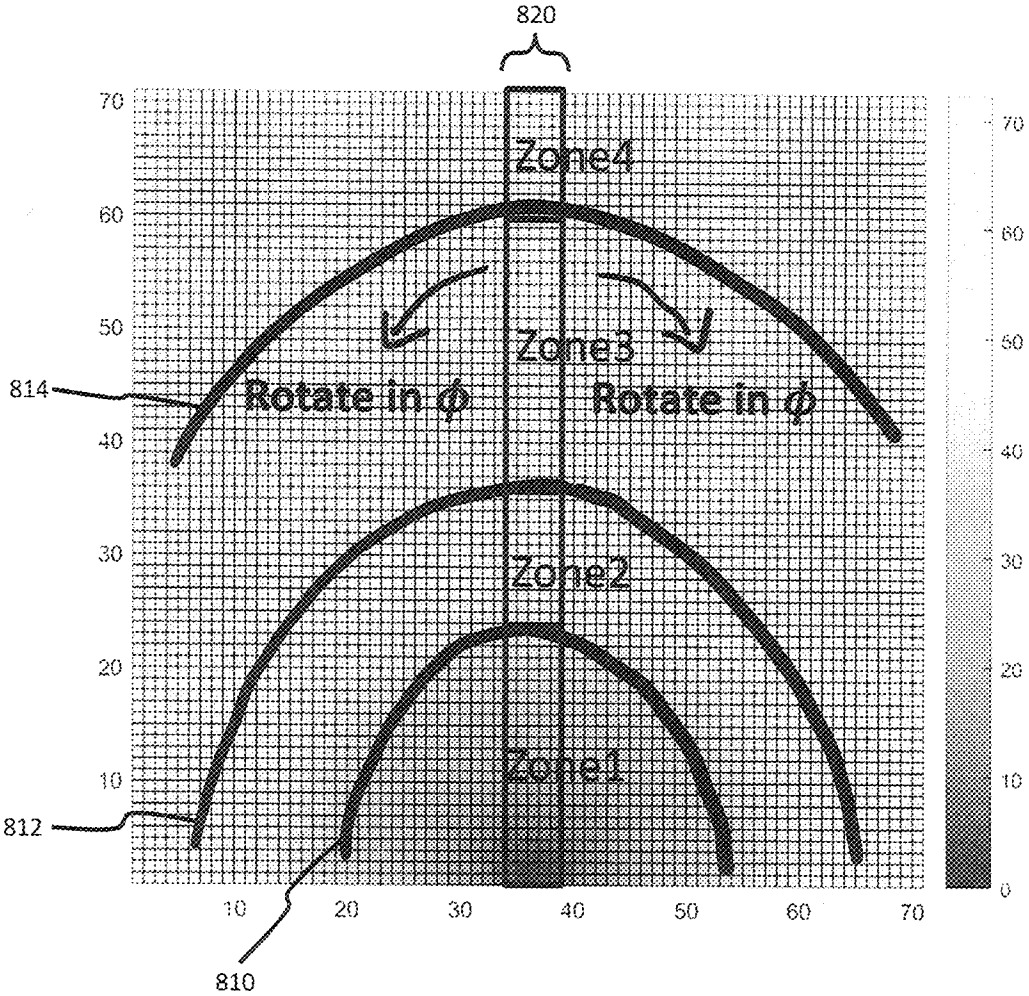
FIG. 8 is a diagram illustrating zones that can be defined on a frequency selective surface panel, according to further embodiments.

FIG. 8 is a diagram illustrating zones that can be defined on a frequency selective surface panel, according to further embodiments. According to the illustrated embodiment, the surface of the FSS panel is not radially divided using multiple radial lines. Rather, the Φ component is constrained to a value of 0°. Various embodiments, however, allow constraining the Φ component to a small range of values, e.g., ±1°, ±2°, ±3°, etc. Next, the surface of the FSS panel is rotationally divided based on predetermined θ component values. For example, each θ component value is mapped as an arc on the surface of the FSS panel. For example, arc 810 corresponds to a first value of the θ component for incident angles of waves from the first feedhorn. Arc 812 corresponds to a second value for the θ component of incident angles of waves from the first feedhorn. Arc 814 corresponds to a third value for the θ component of incident angles of waves from the first feedhorn. As illustrated in FIG. 8, zones 1-4 are defined by the arcs. According to further embodiments, if the Φ component is constrained to a small range of values, a rectangular element 820 can be defined. The values of the θ component can be used to segment the rectangular element 820 into multiple zone segments. The actual zones for the FSS panel can be obtained by rotating the segmented rectangular element 820 in the direction of the Φ component.

Figure 9:
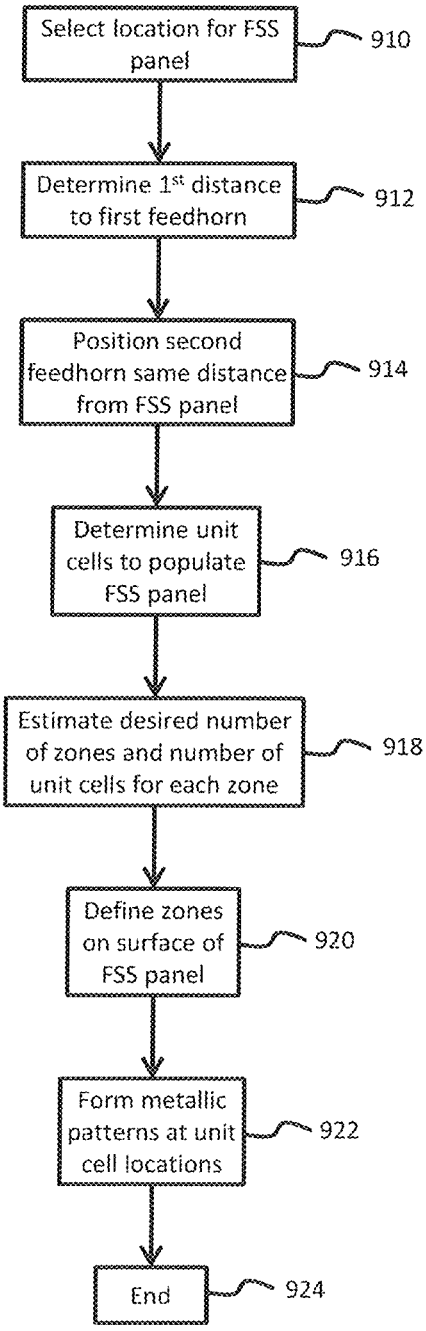
FIG. 9 is a flowchart of a process for designing a frequency selective surface panel, according to one embodiment.

FIG. 9 is a flowchart illustrating various steps performed to design an FSS panel in accordance with one or more embodiments. At 910, a location is selected for placing the FSS panel. The location for the FSS panel can be selected, for example, based on factors such as the size of the reflector dish, the distance between the feed horn and the reflector dish, etc. At 912, the actual distance between the first feedhorn and the FSS panel is determined. Thus, once a location has been selected for the FSS panel, the precise distance between the first feedhorn and the FSS panel is determined or measured. More particularly, the FSS panel is placed (or mounted) on a support arm of the reflector antenna unit. The distance between the point of contact with the support arm and the mounting location of the first feedhorn is measured.

At 914, a second feedhorn is positioned on the support arm of the reflector antenna unit. Furthermore, the distance between the second feedhorn and the FSS panel is identical to the distance between the first feedhorn and the FSS panel. At 916, the number of unit cells required to populate the FSS panel is determined. As previously discussed, the size of the unit cells can vary based on a desired system requirement or design application. Thus, the total unit cells required to populate the surface of the FSS panel would be less if the unit cell dimensions are large, whereas the total number of unit cells required to populate the surface of the FSS panel would be greater if the unit cell dimensions are small.

At 918, the number of zones desired for the FSS panel is estimated. Additionally, the number of unit cells for each zone is estimated or determined. At 920, a plurality of zones are defined on the surface of the FSS panel. According to at least one embodiment, each zone can contain unit cells having identical metallic patterns in order to optimize the zone for a small range of incident angles. If a desired frequency response and/or system requirement are known in advance, unit cells having specific metallic patterns can be preselected for arrangement within the different zones formed on the FSS panel. Metallic patterns are formed at the unit cell locations at 922. Depending on the specific application, various designs and/or geometric shapes can be used as the metallic patterns. The process subsequently ends at 924.

Figure 10:
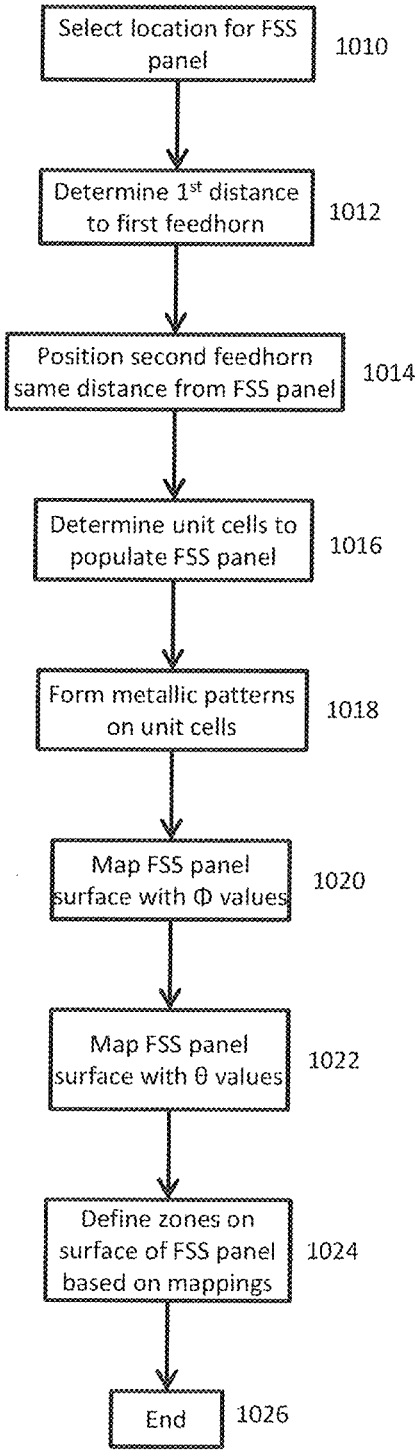
FIG. 10 is a flowchart of a process for designing a frequency selective surface panel, according to one or more embodiments.

FIG. 10 is a flowchart of a process for designing a frequency selective surface panel, according to one or more embodiments. At 1010, a location is selected for the FSS panel. As previously discussed, the location can vary depending on factors including, but not limited to, the size of the reflector dish and the incident angle between the first feedhorn and the reflector dish. Once the location for the FSS panel is selected, at 1012, the precise distance between the FSS panel and the first feedhorn is measured along a support arm of the reflector antenna unit. At 1014, a second feedhorn is positioned on the support arm of the reflector antenna unit. According to various embodiments, the second feedhorn is positioned such that its distance from the FSS panel is identical to the distance between the first feedhorn and the FSS panel.

At 1016, the number of unit cells required the populate the FSS panel is determined. As previously discussed, the number of unit cells required can depend on various factors including design criteria, available hardware (e.g., prefabricated PET film and foam backing), and desired frequency response. Thus, the number of unit cells to be used for populating the FSS panel will vary. At 1018, metallic patterns are formed on each of the unit cells. Depending on the particular system or design requirements, various configurations can be used for the metallic patterns. For example, a Jerusalem cross, a rectangular ring, etc. can all be used as metallic patterns depending on the specific design requirements. At 1020, the FSS panel surface is mapped with a plurality of Φ angle values. According to at least one embodiment, the Φ angle corresponds to a component of the incident wave used by the first feedhorn to illuminate the surface of the reflector dish.

At 1022, the FSS panel surface is mapped with a plurality of θ angle values. According to various embodiments, the angle θ represents a component of the incident angle at which electromagnetic waves from the first feedhorn reach the FSS panel surface. At 1024, a plurality of zones are defined on the surface of the FSS panel. According to various embodiments, the zones can be defined based on the mappings generated using the Φ and θ angle values. The process subsequently ends at 1026.

Figure 11:
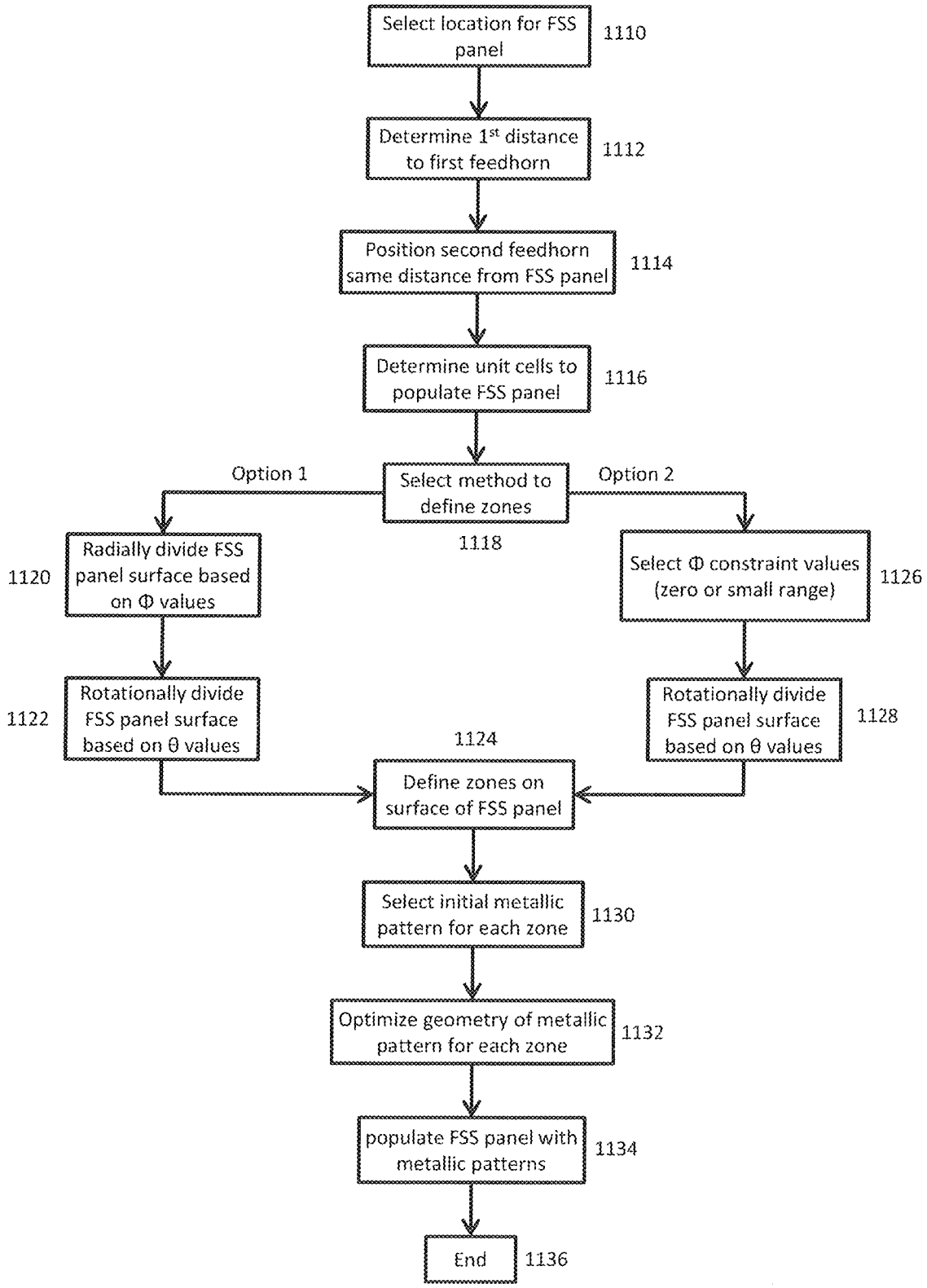
FIG. 11 is a flowchart of a process for designing a frequency selective surface panel, according to various embodiments.

FIG. 11 is a flowchart of a process for designing a frequency selective surface panel, according to various embodiments. At 1110, a location is selected for the FSS panel. At 1112, a first distance is determined between the FSS panel and the feedhorn. More particularly, the distance is determined from the point at which the FSS panel is mounted on an arm of the reflector antenna unit to the first feedhorn. At 1114, a second feedhorn is positioned on the support arm of the reflector antenna unit. The second feedhorn is positioned such that it's distance to the FSS panel is the same as the distance between the FSS panel and the first feedhorn.

At 1116, the number of unit cells required to populate the FSS panel is determined. At 1118, an option is selected for defining the zones on the surface of the FSS panel. According to a first option, at 1120, the surface of the FSS panel is radially divided based on different Φ angle values. As previously discussed, each value of Φ can be represented as a radial line. At 1122, the FSS panel surface is rotationally divided based on different θ angle values. According to at least one embodiment, each θ value results in an arc being mapped on the surface of the FSS panel. At 1124, the different zones are defined on the surface of the FSS panel. For example, after radially dividing the FSS panel based on Φ angle values and rotationally dividing the FSS panel surface based on θ values, the radially divided surface and the rotationally divided surface can be superimposed on each other such that intersections of radial lines and arcs defining the different zones.

Returning to 1118, a second option can also be selected for defining the zones on the surface of the FSS panel. At 1126, a constraint value is selected for the Φ angle. According to at least one embodiment the Φ angle can be constrained to a zero value, which can be represented as a single radial line at a vertical orientation. Alternatively, a small range of values can be used as the constraint for the Φ angles. For example, the values can range from ±1°, ±2°, ±3°, etc. At 1128, the FSS panel surface is rotationally divided based on the θ angle values. Control then passes to 1124, where the different zones are defined on the FSS panel surface. As previously discussed, rotationally dividing the FSS panel surface based on θ values results in a plurality of arcs being formed on the surface. Since the FSS panel surface is only divided based on θ values the different zones are defined solely by the different arcs used to represent the 00 values. More particularly, each zone can be defined by two arcs, or by one arc plus the outer periphery of the FSS panel. At 1130, initial metallic patterns to be used in each of the defined zones are. At 1132, the metallic pattern geometries are optimized for the particular design requirements. According to various embodiments, however, the metallic patterns may be formed on the unit cells prior to defining the different zones and optimized based on specific design requirements. At 1134, the FSS panel is populated with the metallic patterns. More particularly, each zone is populated with the specific metallic pattern optimized for the zone. At 1136, the process ends.

Various features described herein may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. The terms software, computer software, computer program, program code, and application program may be used interchangeably and are generally intended to include any sequence of machine or human recognizable instructions intended to program/configure a computer, processor, server, etc. to perform one or more functions. Such software can be rendered in any appropriate programming language or environment including, without limitation: C, C++, C #, Python, R, Fortran, COBOL, assembly language, markup languages (e.g., HTML, SGML, XML, VoXML), Java, JavaScript, etc. As used herein, the terms processor, microprocessor, digital processor, and CPU are meant generally to include all types of processing devices including, without limitation, single/multi-core microprocessors, digital signal processors (DSPs), reduced instruction set computers (RISC), general-purpose (CISC) processors, gate arrays (e.g., FPGAs), PLDs, reconfigurable compute fabrics (RCFs), array processors, secure microprocessors, and application-specific integrated circuits (ASICs). Such digital processors may be contained on a single unitary IC die, or distributed across multiple components. Such exemplary hardware for implementing the described features are detailed below.

Figure 12:
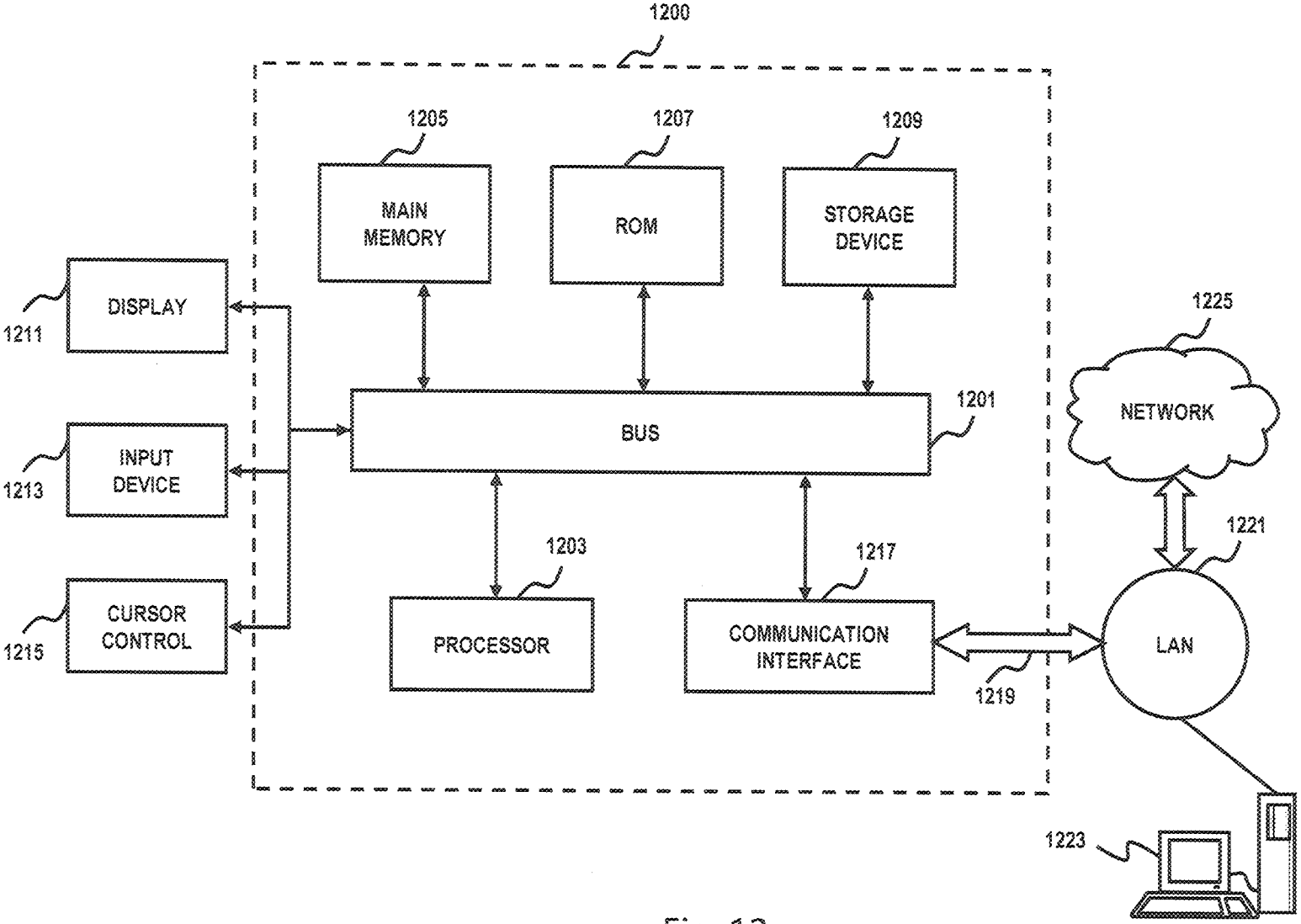
FIG. 12 is a diagram of a computer system that can be used to implement various exemplary features and embodiments.

FIG. 12 is a diagram of a computer system that can be used to implement features of various embodiments. The computer system 1200 includes a bus 1201 or other communication mechanism for communicating information and a processor 1203 coupled to the bus 1201 for processing information. The computer system 1200 also includes main memory 1205, such as a random access memory (RAM), dynamic random access memory (DRAM), synchronous dynamic random access memory (SDRAM), double data rate synchronous dynamic random-access memory (DDR SDRAM), DDR2 SDRAM, DDR3 SDRAM, DDR4 SDRAM, etc., or other dynamic storage device (e.g., flash RAM), coupled to the bus 1201 for storing information and instructions to be executed by the processor 1203. Main memory 1205 can also be used for storing temporary variables or other intermediate information during execution of instructions by the processor 1203. The computer system 1200 may further include a read only memory (ROM) 1207 or other static storage device coupled to the bus 1201 for storing static information and instructions for the processor 1203. A storage device 1209, such as a magnetic disk or optical disk, is coupled to the bus 1201 for persistently storing information and instructions.

The computer system 1200 may be coupled via the bus 1201 to a display 1211, such as a light emitting diode (LED) or other flat panel displays, for displaying information to a computer user. An input device 1213, such as a keyboard including alphanumeric and other keys, is coupled to the bus 1201 for communicating information and command selections to the processor 1203. Another type of user input device is a cursor control 1215, such as a mouse, a trackball, or cursor direction keys, for communicating direction information and command selections to the processor 1203 and for controlling cursor movement on the display 1211. Additionally, the display 1211 can be touch enabled (i.e., capacitive or resistive) in order facilitate user input via touch or gestures.

According to an exemplary embodiment, the processes described herein are performed by the computer system 1200, in response to the processor 1203 executing an arrangement of instructions contained in main memory 1205. Such instructions can be read into main memory 1205 from another computer-readable medium, such as the storage device 1209. Execution of the arrangement of instructions contained in main memory 1205 causes the processor 1203 to perform the process steps described herein. One or more processors in a multi-processing arrangement may also be employed to execute the instructions contained in main memory 1205. In alternative embodiments, hard-wired circuitry may be used in place of or in combination with software instructions to implement exemplary embodiments. Thus, exemplary embodiments are not limited to any specific combination of hardware circuitry and software.

The computer system 1200 also includes a communication interface 1217 coupled to bus 1201. The communication interface 1217 provides a two-way data communication coupling to a network link 1219 connected to a local network 1221. For example, the communication interface 1217 may be a digital subscriber line (DSL) card or modem, an integrated services digital network (ISDN) card, a cable modem, fiber optic service (FiOS) line, or any other communication interface to provide a data communication connection to a corresponding type of communication line. As another example, communication interface 1217 may be a local area network (LAN) card (e.g. for Ethernet™ or an Asynchronous Transfer Mode (ATM) network) to provide a data communication connection to a compatible LAN. Wireless links can also be implemented. In any such implementation, communication interface 1217 sends and receives electrical, electromagnetic, or optical signals that carry digital data streams representing various types of information. Further, the communication interface 1217 can include peripheral interface devices, such as a Universal Serial Bus (USB) interface, a High Definition Multimedia Interface (HDMI), etc. Although a single communication interface 1217 is depicted in FIG. 12, multiple communication interfaces can also be employed.

The network link 1219 typically provides data communication through one or more networks to other data devices. For example, the network link 1219 may provide a connection through local network 1221 to a host computer 1223, which has connectivity to a network 1225 such as a wide area network (WAN) or the Internet. The local network 1221 and the network 1225 both use electrical, electromagnetic, or optical signals to convey information and instructions. The signals through the various networks and the signals on the network link 1219 and through the communication interface 1217, which communicate digital data with the computer system 1200, are exemplary forms of carrier waves bearing the information and instructions.

The computer system 1200 can send messages and receive data, including program code, through the network(s), the network link 1219, and the communication interface 1217. In the Internet example, a server (not shown) might transmit requested code belonging to an application program for implementing an exemplary embodiment through the network 1225, the local network 1221 and the communication interface 1217. The processor 1203 may execute the transmitted code while being received and/or store the code in the storage device 1209, or other non-volatile storage for later execution. In this manner, the computer system 1200 may obtain application code in the form of a carrier wave.

The term "computer-readable medium" as used herein refers to any medium that participates in providing instructions to the processor 1203 for execution. Such a medium may take many forms, including but not limited to non-volatile media, volatile media, and transmission media. Non-volatile media include, for example, optical or magnetic disks, such as the storage device 1209. Non-volatile media can further include flash drives, USB drives, microSD cards, etc. Volatile media include dynamic memory, such as main memory 1205. Transmission media include coaxial cables, copper wire and fiber optics, including the wires that comprise the bus 1201. Transmission media can also take the form of acoustic, optical, or electromagnetic waves, such as those generated during radio frequency (RF) and infrared (IR) data communications. Common forms of computer-readable media include, for example, a USB drive, microSD card, hard disk drive, solid state drive, optical disk (e.g., DVD, DVD RW, Blu-ray), or any other medium from which a computer can read.

Figure 13:
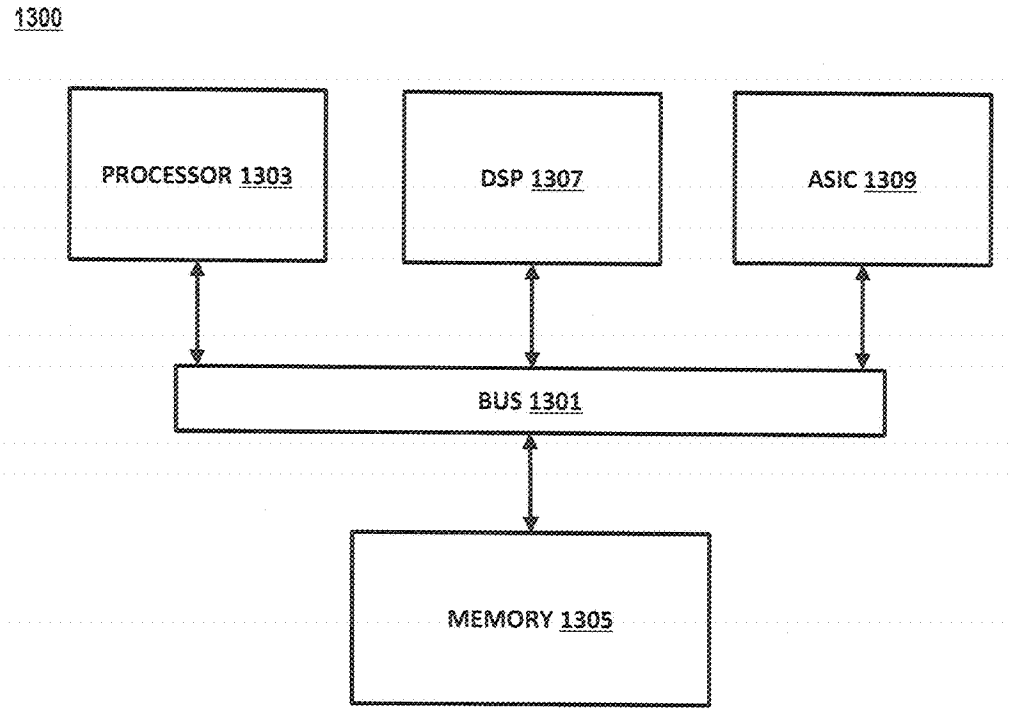
FIG. 13 is a diagram of a chip set that can be used to implement various exemplary features and embodiments.

FIG. 13 illustrates a chip set 1300 upon which features of various embodiments may be implemented. Chip set 1300 is programmed to implement various features as described herein and includes, for instance, the processor and memory components described with respect to FIG. 13 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip. Chip set 1300, or a portion thereof, constitutes a means for performing one or more steps of the figures.

In one embodiment, the chip set 1300 includes a communication mechanism such as a bus 1301 for passing information among the components of the chip set 1300. A processor 1303 has connectivity to the bus 1301 to execute instructions and process information stored in, for example, a memory 1305. The processor 1303 may include one or more processing cores with each core configured to perform independently. A multi-core processor enables multiprocessing within a single physical package. Examples of a multi-core processor include two, four, eight, or greater numbers of processing cores. Alternatively or in addition, the processor 1303 may include one or more microprocessors configured in tandem via the bus 1301 to enable independent execution of instructions, pipelining, and multithreading. The processor 1303 may also be accompanied with one or more specialized components to perform certain processing functions and tasks such as one or more digital signal processors (DSP) 1307, or one or more application-specific integrated circuits (ASIC) 1309. A DSP 1307 typically is configured to process real-world signals (e.g., sound) in real time independently of the processor 1303. Similarly, an ASIC 1309 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1303 and accompanying components have connectivity to the memory 1305 via the bus 1301. The memory 1305 includes both dynamic memory (e.g., RAM, magnetic disk, re-writable optical disk, etc.) and static memory (e.g., ROM, CD-ROM, DVD, BLU-RAY disk, etc.) for storing executable instructions that when executed perform the inventive steps described herein. The memory 1305 also stores the data associated with or generated by the execution of the inventive steps.

While certain exemplary embodiments and implementations have been described herein, other embodiments and modifications will be apparent from this description. Accordingly, the various embodiments described are not intended to be limiting, but rather are encompassed by the broader scope of the presented claims and various obvious modifications and equivalent arrangements.

What is claimed is:

1. A method comprising:

positioning a frequency selective surface (FSS) panel at a first distance from a first feedhorn along a support arm of a reflector antenna system, wherein the first feedhorn is configured to operate in a first frequency range;

positioning a second feedhorn on the support arm at a second distance from the FSS panel, the second distance being equal to the first distance and in an opposite direction from the FSS panel, wherein the second feedhorn is configured to operate in a second frequency range;

determining a number of unit cells required to form the FSS panel based, at least in part, on the selected location and the first distance;

forming metallic patterns on each unit cell; and defining one or more zones on the surface of the FSS panel, each zone having unit cells with different metallic patterns, wherein the FSS panel transmits waves in the first frequency range and reflects waves in the second frequency range, and wherein each of the one or more zones is configured to be optimized by an area defined by a portion of at least one of a plurality of radial lines, a portion of at least one of a plurality of arcs, or both, wherein each radial line corresponds to a value for a predetermined $\Phi$ component of an incident angle of waves from the first feedhorn, each arc corresponds to a value for a predetermined$\theta$ component of an incident angle of waves from the first feedhorn, and the plurality of radial lines radially divide a surface of the FSS panel and the plurality of arcs rotationally divide a surface of the FSS panel.

2. The method of claim 1, further comprising sizing the FSS panel to provide coverage over an entire surface area of a reflector dish illuminated by the first feedhorn.

3. The method of claim 1, wherein the one or more zones are defined based, at least in part, on the $\Phi$ component and the $\theta$ component of incident angles of waves from the first feedhorn.

4. The method of claim 1, wherein defining one or more zones further comprises:

mapping the FSS panel surface with a plurality of values for the Φ component of incident angles of waves from the first feedhorn; and mapping the FSS panel surface with a plurality of values for the θ component of incident angles of waves from the first feedhorn.

5. The method of claim 1, wherein defining one or more zones comprises:

radially dividing the FSS panel surface using a plurality of radial lines, each radial line corresponding to the value of the predetermined Φ component of incident angles of waves from the first feedhorn; and rotationally dividing the FSS panel surface using a plurality of arcs, each arc corresponding to the value of the predetermined θ component of incident angles of waves from the first feedhorn.

6. The method of claim 1, wherein defining one or more zones comprises:

radially dividing the FSS panel surface in half using a radial line corresponding to a zero value for the Φ component of incident angles of waves from the first feedhorn; and rotationally dividing the FSS panel surface using a plurality of arcs, each arc corresponding to the value for the predetermined θ component of incident angles of waves from the first feedhorn.

7. The method of claim 1, further comprising optimizing a geometry of metallic patterns formed on the unit cells in each of the one or more zones.

8. The method of claim 7, wherein the geometry of the metallic patterns is optimized based on the Φ component and the θ component of incident angles of waves from the first feedhorn within each of the one or more zones.

9. The method of claim 7, wherein optimizing a geometry comprises selecting one or more shapes, from a plurality of geometric patterns, to be formed on each unit cell.

10. The method of claim 9, further comprising adjusting at least one dimension of the geometric patterns.

11. A system comprising:

a reflector antenna unit comprising a reflector dish mounted on a base, a support arm extending from the base, a first feedhorn mounted at an end of the support arm and configured to operate in a first frequency range, and a second feedhorn mounted on the support arm and configured to operate in a second frequency range; and an FSS panel disposed between the first feedhorn and the second feedhorn, the FSS panel comprising a foam backing, a dielectric film disposed on the foam backing, a plurality of unit cells defined on the dielectric film, a plurality of metallic patterns formed on the dielectric film, and one or more zones defined on a surface of the FSS panel, wherein each of the one or more zones is configured to be optimized by an area defined by a portion of at least one of a plurality of radial lines, a portion of at least one of a plurality of arcs, or both, wherein each radial line corresponds to a value for a predetermined Φ component of an incident angle of waves from the first feedhorn, each arc corresponds to a value for a predetermined θ component of an incident angle of waves from the first feedhorn, and the plurality of radial lines radially divide a surface of the FSS panel and the plurality of arcs rotationally divide a surface of the FSS panel, wherein the FSS panel is equidistant from both the first feedhorn and the second feedhorn, and wherein the FSS panel transmits waves in the first frequency range and reflects waves in the second frequency range.

12. The system of claim 11, wherein the FSS panel is sized to provide coverage over an entire surface area of the reflector dish illuminated by the first feedhorn.

13. The system of claim 11, wherein the one or more zones are defined based, at least in part, on Φ component and the θ component of incident angles of waves from the first feedhorn.

14. The system of claim 11, wherein each of the one or more zones comprises:

an area defined by two adjacent arcs from a plurality of arcs that rotationally divide a surface of the FSS panel, wherein each arc corresponds to a value for a predetermined 0 component of an incident angle of waves from the first feedhorn.

15. The system of claim 11, wherein:

the FSS panel comprises a plurality of layers; and each layer includes a foam backing, a dielectric film, and a plurality of unit cells.

16. The system of claim 11, wherein a geometry of the metallic patterns is optimized based on the Φ component and the θ component of incident angles of waves from the first feedhorn within each of the one or more zones.

17. The system of claim 16, wherein:

the metallic patterns contain at least one dimension that can be adjusted; and a geometry of the geometry of the metallic patterns is further optimized by adjusting the at least one dimension.

* * * * *